US009756930B2

(12) United States Patent
Hanchett et al.

(10) Patent No.: US 9,756,930 B2
(45) Date of Patent: Sep. 12, 2017

(54) METHODS AND APPARATUS FOR A LOW-PROFILE COUPLER

(71) Applicant: TASER International, Inc., Scottsdale, AZ (US)

(72) Inventors: Mark A. Hanchett, Mesa, AZ (US); John W. Wilson, Phoenix, AZ (US); Nathan A. Patulski, Scottsdale, AZ (US); William J. Soper, Bristol (GB)

(73) Assignee: Axon Enterprise, Inc., Scottsdale, AZ (US)

( * ) Notice: Subject to any disclaimer, the term of this patent is extended or adjusted under 35 U.S.C. 154(b) by 280 days.

(21) Appl. No.: 14/698,750

(22) Filed: Apr. 28, 2015

(65) Prior Publication Data

US 2016/0316900 A1 Nov. 3, 2016

(51) Int. Cl.
*A41F 1/00* (2006.01)
*A45F 5/02* (2006.01)

(52) U.S. Cl.
CPC ..... *A45F 5/02* (2013.01); *A45F 2005/026* (2013.01); *A45F 2200/0508* (2013.01); *A45F 2200/0516* (2013.01)

(58) Field of Classification Search
CPC ..... Y10T 24/4501; Y10T 24/45037; Y10T 24/45089; Y10T 24/13
See application file for complete search history.

(56) References Cited

U.S. PATENT DOCUMENTS 3,860,209 A * 1/1975 Strecker ..... B60P 7/13 24/265 CD
4,400,856 A * 8/1983 Tseng ..... B60P 7/13 24/109
4,507,032 A 3/1985 Rosaia
4,527,760 A * 7/1985 Salacuse ..... A47K 1/09 24/DIG. 53
4,778,252 A * 10/1988 Filho ..... F16B 21/10 279/133
5,240,424 A 8/1993 Honma
5,274,885 A * 1/1994 Hellweg ..... A45F 5/02 224/272
5,368,427 A * 11/1994 Pfaffinger ..... F16B 21/04 24/580.1

(Continued)

FOREIGN PATENT DOCUMENTS

WO 9716650 5/1997
WO WO2012153086 A1 11/2012

OTHER PUBLICATIONS

AH&H Hardware, Buddy-Lok II Tactical Pouch Attachment System, www.ahh.biz/hardware/miscellanous/buddy-lok_black_plastic.php, Feb. 2, 2015.

*Primary Examiner* — Robert J Sandy
*Assistant Examiner* — Jason W San
(74) *Attorney, Agent, or Firm* — Lawrence Letham

(57) ABSTRACT

A coupler for removable coupling an object to a support. The coupler includes a cover, a ring, and a base. The cover couples to the support. The ring includes a first arm, a second arm, a third arm, a fourth arm, a first stop, and a second stop. Each arm of the ring is formed of a resilient material. The ring is positioned in a cavity of the cover. The base couples to the accessory. The base cooperates with the cover and the ring to couple to the cover and to rotate from a decoupled position to an intermediate position and further to a clocked position.

16 Claims, 11 Drawing Sheets

(56) References Cited

U.S. PATENT DOCUMENTS 5,416,549 A * 5/1995 Katsuyama ..... H04N 5/2251 348/E5.025
5,604,958 A * 2/1997 Anscher ..... A45C 7/0086 224/197
5,655,865 A * 8/1997 Plank ..... E04D 3/08 403/257
5,772,478 A * 6/1998 Kuempel ..... H01R 13/4361 439/752
6,009,601 A * 1/2000 Kaufman ..... A41F 1/002 24/303
6,170,131 B1 * 1/2001 Shin ..... A41F 1/002 24/303
6,177,877 B1 1/2001 Munyon
6,305,588 B1 * 10/2001 Michel ..... A45F 5/02 224/195
6,332,281 B1 12/2001 Savoie
6,564,434 B1 * 5/2003 Morita ..... A45C 13/1069 24/114.2
6,631,571 B2 10/2003 McMullin
6,634,616 B2 10/2003 Belknap
6,929,226 B1 8/2005 Philistine
7,032,931 B2 4/2006 Austin
7,120,972 B2 * 10/2006 O' Banion ..... A42B 1/24 24/303
7,619,387 B2 11/2009 Amend
7,748,091 B2 * 7/2010 Bogh-Sorensen .... F16B 21/165 24/573.11
8,459,472 B2 6/2013 Hofman
8,615,853 B2 * 12/2013 Rathbun ..... H01F 7/0252 24/3.1
8,695,170 B2 * 4/2014 Honeycutt ..... A44C 15/003 24/3.1
8,794,682 B2 * 8/2014 Fiedler ..... A45C 13/1069 24/303
9,078,508 B2 * 7/2015 Ramsey ..... A45C 11/22
2002/0152590 A1 * 10/2002 Lin ..... A41F 1/002 24/303
2005/0046179 A1 3/2005 Lee
2005/0121912 A1 6/2005 Benscoter
2006/0143863 A1 7/2006 Schoolcraft
2006/0207072 A1 * 9/2006 Chen ..... A44B 11/2588 24/580.1
2008/0064342 A1 3/2008 Son
2008/0155788 A1 * 7/2008 Wilcox ..... A43B 3/0078 24/3.1
2012/0174341 A1 * 7/2012 Rogers ..... A45F 5/02 24/3.1
2012/0304420 A1 * 12/2012 Huberts ..... A41B 9/04 24/3.1
2014/0068895 A1 * 3/2014 Hanaoka ..... A44C 1/00 24/3.1
2015/0013111 A1 * 1/2015 White ..... H04R 1/025 24/3.1
2016/0186789 A1 * 6/2016 Nelson ..... F16B 1/00 24/303

* cited by examiner

METHODS AND APPARATUS FOR A LOW-PROFILE COUPLER

FIELD OF THE INVENTION

Embodiments of the present invention relate to mechanical couplers that enable coupling and decoupling without the use of tools for releasably coupling an object to a support and rotationally positioning the object relative to the support, and in particular for coupling a recording device (e.g., digital video recorder, microphone, camera) to a clothing.

BRIEF DESCRIPTION OF THE DRAWING

Embodiments of the present invention will be described with reference to the drawing, wherein like designations denote like elements, and.

DETAILED DESCRIPTION OF THE PREFERRED EMBODIMENTS

Figure 1:
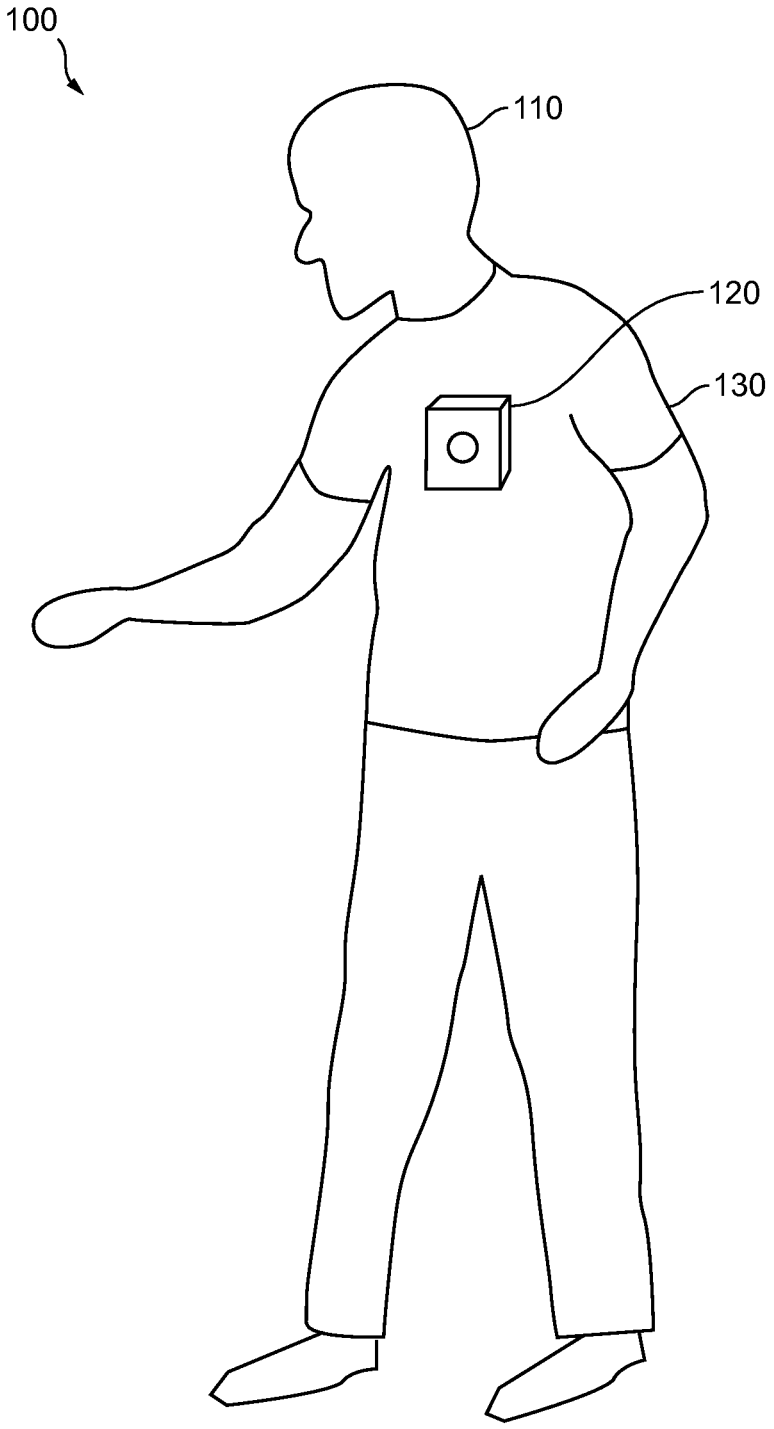
FIG. 1 is a front view of a digital video recorder ("DVR") coupled to a clothing (e.g., support) and positioned by the coupler according to various aspects of the present invention.

The coupler of the present invention may be used to couple any suitable object to any suitable support. The coupler of the present invention may be used to position (e.g., orient) an object with respect to a support. In an implementation, the coupler of the present invention releasably couples a DVR to equipment (e.g., clothing, uniform, belt, glasses, hat, helmet, shirt, backpack, wristband, harness) used and/or worn by a person (e.g., witness, participant, user, investigator, police officer). In an implementation, coupler 200 of FIGS. 1-10 includes base 210, cover 220, and ring 310.

A base is the portion of the coupler that couples (e.g., attaches, connects) to the object. The cover is the portion of the coupler that couples to the support. The base releasably couples to the cover thereby releasably coupling the object to the support. A releasable coupler enables a user to remove the object from the support.

A base may be positioned (e.g., oriented) with respect to a cover so that an object may be positioned with respect to a support.

The base may be release from or coupled to the cover without the use of tools. So, an object may be coupled to a support manually by a person without the use of tools. Because the coupler is releasable, an object may be released (e.g., removed) from one support and coupled to another support that includes a cover for receiving the base coupled to the object.

A base may be coupled to an object so that it may not be easily removed from the object. A cover may be coupled to a support so that it may not be easily removed from the support. The base may be coupled to an object at an orientation and the cover coupled to a support at an orientation so that when the base is releasably coupled to the cover, the object is positioned (e.g., oriented) with respect to the support. The orientation of the object with respect to the support may facilitate the operation (e.g., use, function) of the object.

A base may move closer to (e.g., in, toward) and away from (out, outward) from a cover. Because the base couples to an object and a cover couples to a support, as the base moves toward and away from the cover, the object moves toward and away from the support. A base may move closer to and away from a cover along an axis. When the base moves toward the cover along the axis, a portion of the base may be inserted (e.g., enter) into a portion of the cover. A base may rotate (e.g., turn) with respect to a cover. Because the base couples to an object and a cover couples to a support, the base may rotate as a result of a user rotating the object with respect to the support.

As discussed herein, movement of the base with respect to the cover discloses movement of the object with respect to the support because the base couples to the object and the cover couples to the support. Any discussion of movement of the base also describes movement of the object and vice versa. Any discussion of the cover relates to the support because the cover couples to the support. In an implementation where the base couples to a DVR and the cover couples to the clothing of a user, the user does not directly contact the base to move and/or rotate the base. The user manually positions the object so that the base is positioned with respect to the cover and with respect to the clothing. The user manually rotates the object so that the base rotates with respect to the cover and with respect to the clothing.

While the portion of the base is inserted into the cover, the base may rotate with respect to the cover. Rotating the base after inserting portion of the base into the cover causes a portion of the cover to interfere with (e.g., obstruct, stop) movement of the base away from the cover along the axis thereby coupling the base to the cover. The base remains coupled to the cover as long as the cover interferes with movement of the base away from the cover or vice versa.

A ring positioned in the cover may retain (e.g., hold, interfere with) a base that is inserted into a cover at a particular rotated position (e.g., orientation). While a ring holds a base that is inserted into a cover at a rotated position, the base cannot be separated from (e.g., move away) the cover, thereby coupling the base to the cover and in turn the object to the support. A ring may hold a base at one or more rotated positions (e.g., orientations). A ring may hold a base, and therefore an object, at a position that provides an environment for proper operation of the object.

A base may couple to an object using any conventional technique for coupling. In an implementation, base 210 includes bores 350 for coupling to an object by screw and/or bolt. A cover may couple to a support using any conventional technique for coupling. In an implementation, cover includes bores 332 for coupling to a support by screw and/or bolt. In another implementation, the cover is sewn to the support. In another implementation, the cover is coupled to a structure that is coupled to the support. In an implementation, the cover is coupled to a piece of material (e.g., plastic, cloth) that in turn is sewn to the clothing of a user. In another implementation, the cover is coupled to magnetic material that magnetically couples to the support.

Figure 2:
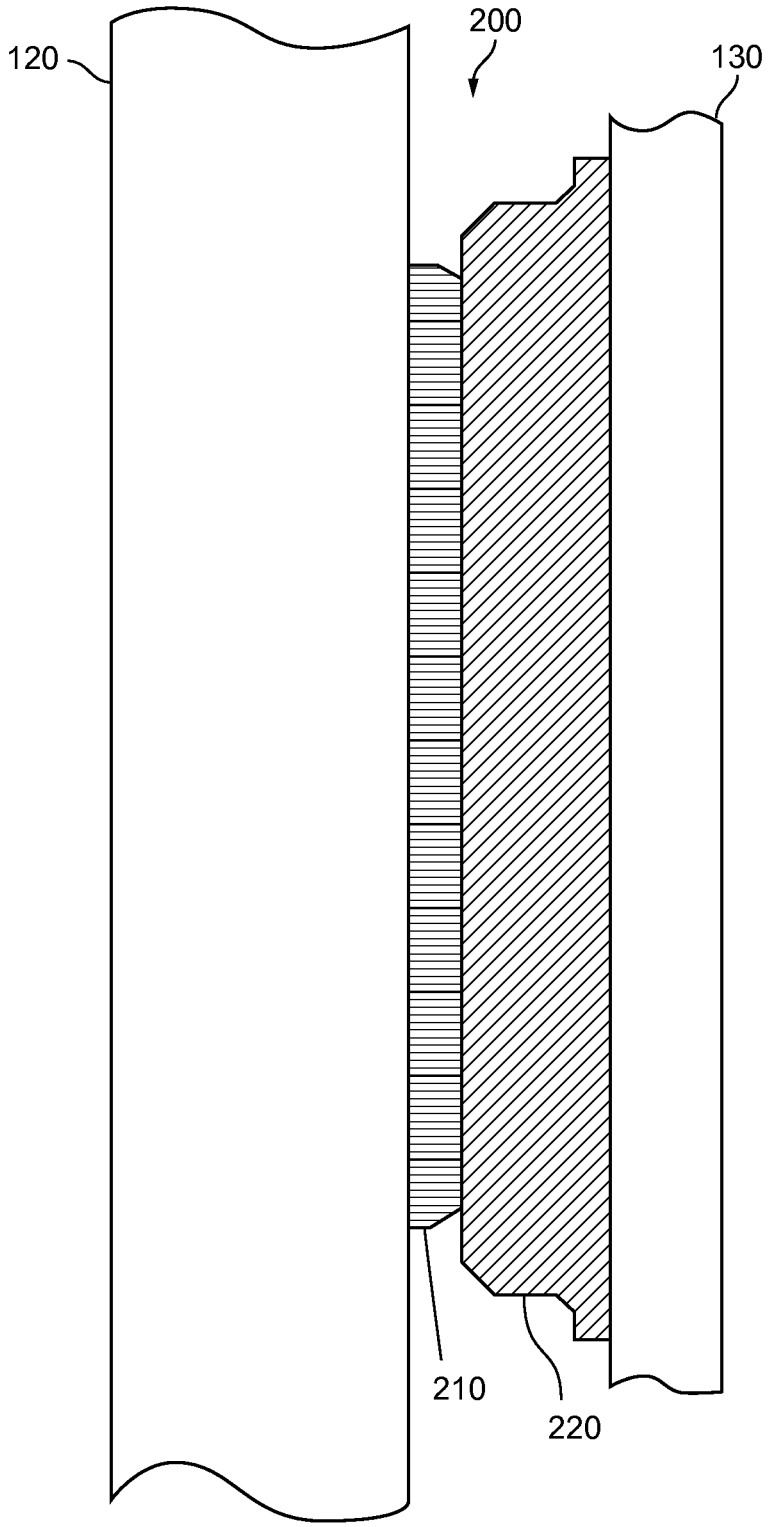
FIG. 2 is a side plan view of the DVR, coupler and support of FIG. 1.
Figure 4:
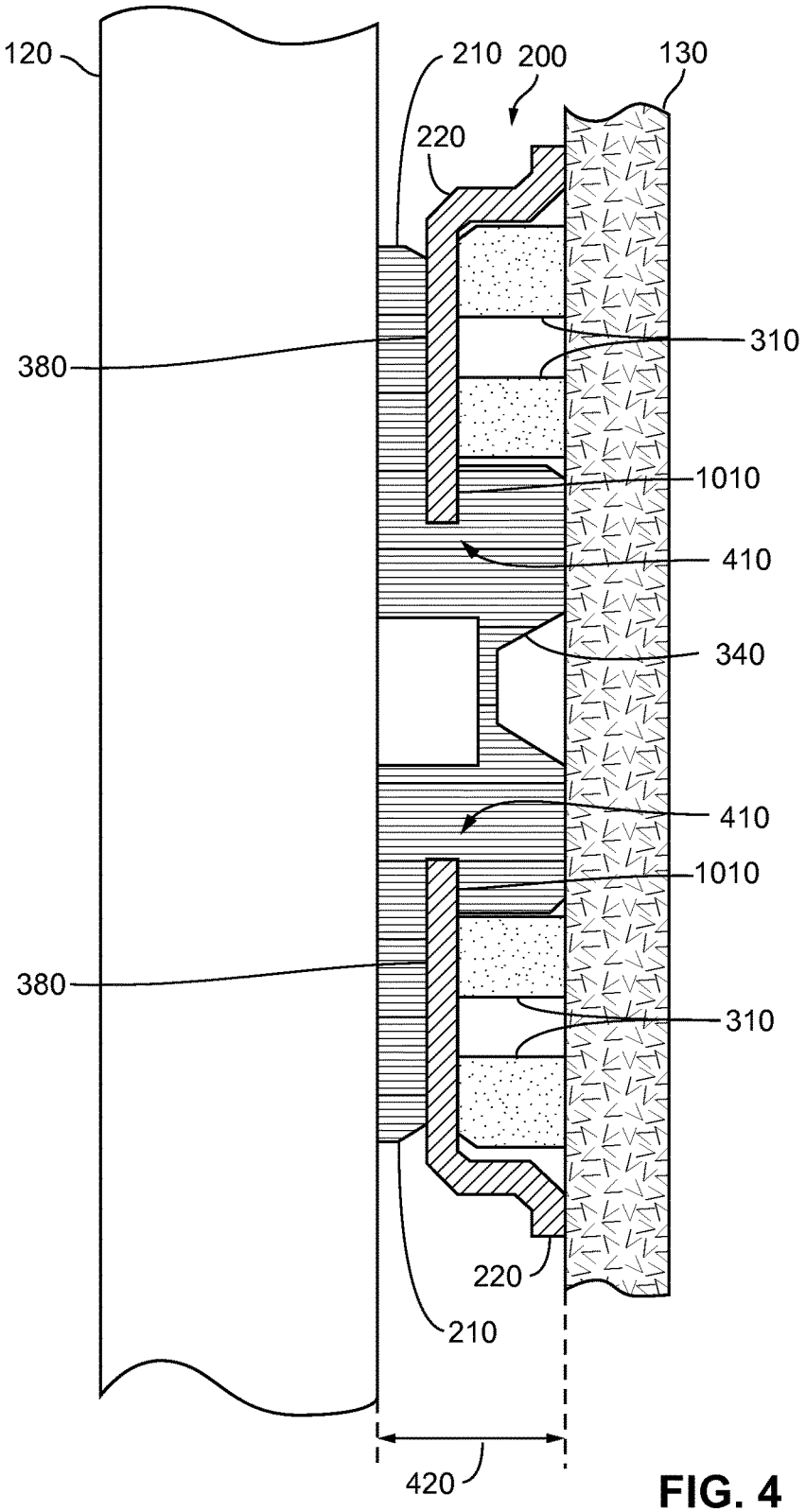
FIG. 4 is a cross-sectional view of the DVR, coupler, and support of FIG. 2 along a center vertical (e.g., top to bottom on page) axis.

In an implementation, the coupler of the present invention releasably couples a DVR to equipment worn by a person. The coupler retains the DVR coupled to the equipment, permits the DVR to be manually removed from or coupled to the equipment, and positions the DVR to record information that occurs in the vicinity of the person. In FIG. 1, DVR 120 (e.g., object) couples to uniform 130 (e.g., support) worn by officer 110 so that DVR 120 may record the events that occur in the vicinity of officer 110 thereby performing the function of a body-worn recording system. As shown in FIGS. 1-2 and 4, coupler 200 couples DVR 120 to uniform 130.

Base 210 that couples to the object includes post 340 having axis 360, surface 380, plate 392, and bores 350. Cover 220 that couples to a support includes surface 336, opening 330 in surface 336, surface 338, bores 332, recess 334, and axis 362. Ring 310 includes arm 312, arm 314, arm 316, arm 318, stop 372, stop 374, opening 320, and axis 364. End portion 610 of arm 312 includes ramp 612 and face 314. End portion 620 of arm 314 includes ramp 622 and face 624. End portion 630 of arm 316 includes ramp 632 and face 634. End portion 640 of arm 318 includes ramp 642 and face 644. Because end portions 610-640 increase in width from ramp 612-642 to the end of each end portion, end portions 610-640 may be described as bulbous.

Base 210 performs the functions of a base discussed above. Cover 220 performs the functions of a cover discussed above. Ring 220 performs the functions of a ring discussed above.

Post 340 of base 210 couples to and projects away from plate 392. As discussed above, bores 350 may be used to couple base to an object (e.g., DVR). While base 210 is coupled to an object, surface 380 faces way from the object. Post 340 includes protrusion 342, protrusion 344, protrusion 346, and protrusion 348. Protrusions 342-348 project away from (e.g., out of) post 340. Protrusions 342-348, as discussed below, interfere with portions of cover 220 to couple base 210 to cover 220.

Protrusions 342-348 extend a distance away from center portion 382 of post 340. Protrusions 342 and 344 extend farther away from center portion 382 than protrusions 346 and 348. The length of the projection of protrusions 342-348 from post 340 may be measured with respect to axis 360. Protrusions 342 and 344 extend a distance 1030 from axis 360. Protrusions 346 and 348 extend a distance 1040 from axis 360. Underside (e.g., undersurface) 1010 of protrusions 342-348 is positioned a distance 1020 away from surface 380 so that slot 410 is formed between undersurface 1010 and surface 380. As discussed below, a portion of cover 220 enters (e.g., engages, interlocks) slots 410 so that underside 1010 contacts surface 336 to couple base 210 to cover 220.

Base 210 may be formed of any material or combination of materials that have suitable properties to perform the functions of a base. Such materials may include metals, plastics, composite materials, or any combination thereof. In one implementation, base 210 is formed of aluminum. In another implementation, base 210 is formed of a durable plastic. Preferably, the material that forms base 210 has sufficient strength so that when base 210 is rotated out of the decoupled position toward the intermediate position, the strength of protrusions 342-348 is sufficient to not break or deform, under normal use, so that base 210 separates from cover 220 and ring 310.

In an implementation in which base 210 is formed of aluminum, thickness 1022 of base 210 from surface 1024 opposite 380 to upper surface 384 is about 5 millimeters (mm). Thickness 1026 of plate 392 of base 210 is about 1.4 mm. The distance between underside 1010 of protrusions 342-348 and surface 380 is about 1 mm. Length 390 of each side of plate 392 is about 42 mm a side.

Arms 312-318 of ring 310 are formed of a resilient material so that when an arm is pushed (e.g., forced, moved) outwardly (e.g., away from the center, away from the central axis, away from axis 364), the arm will return to its original position when the force is removed. Further, when arms 312-318 are forced outwardly, the resilient nature of the material used to form arms 312-318 means that 312-318 will apply a force against the object that pushes the arm outwardly.

Recess (e.g., cavity, depression) 334 of cover 220 is of a shape to accept ring 310 so that ring 310 may be positioned in recess 334. The shape of recess 334 and the corresponding shape of ring 310 include surfaces that interfere with (e.g., block, collide with, hinder) each other (e.g., edges of surface 334, edges of ring 310) so that when a rotational force is applied to ring 310, ring 310 will not turn (e.g., rotate) in recess 334.

The depth (e.g., height) of recess 334 is sufficient so that when ring 310 is positioned in recess 334 that upper surface 376 of ring 310 is flush with or below surface 338 of cover 220. When cover 220 is coupled to a support, recess 334 with ring 310 positioned in recess 334 are oriented toward the support and surface 338 comes into contact with the surface of the support. If upper surface 376 of ring 310 is flush with surface 338, the support will not interfere (e.g., block, collide with, hinder) with movement of arms 312-318. If the height of post 340 is less than the depth of recess 334, the support will not interfere with the rotation of post 340 when it is inserted into cover 220.

Openings 320 and 330 are of a shape and size so that post 340 with protrusions 342-348 may pass through openings 320 and 330 when base 210 is positioned in a position for insertion into opening 330 of cover 220. The position of base 210 with respect to cover 220 and ring 310 when oriented so that post 340 may be inserted into openings 320 and 330 is referred to herein as the decoupled (e.g., insertion) position. In the insertion position, axis 360 of base 210 is aligned with axis 362 of cover 220 and axis 364 of ring 310. Ring 310 is positioned in recess 334. Base 210 is rotated until protrusions 342-348 align with the sides of opening 330 and opening 320. Base 210 is then moved toward cover 220 so that post 340 passes into opening 330 and opening 320. Base 210 may be moved toward cover 220 until it stops when surface 380 touches cover 220. The position of post 340 relative to opening 320 while in the decoupled position is show in FIG. 7.

Figure 3:
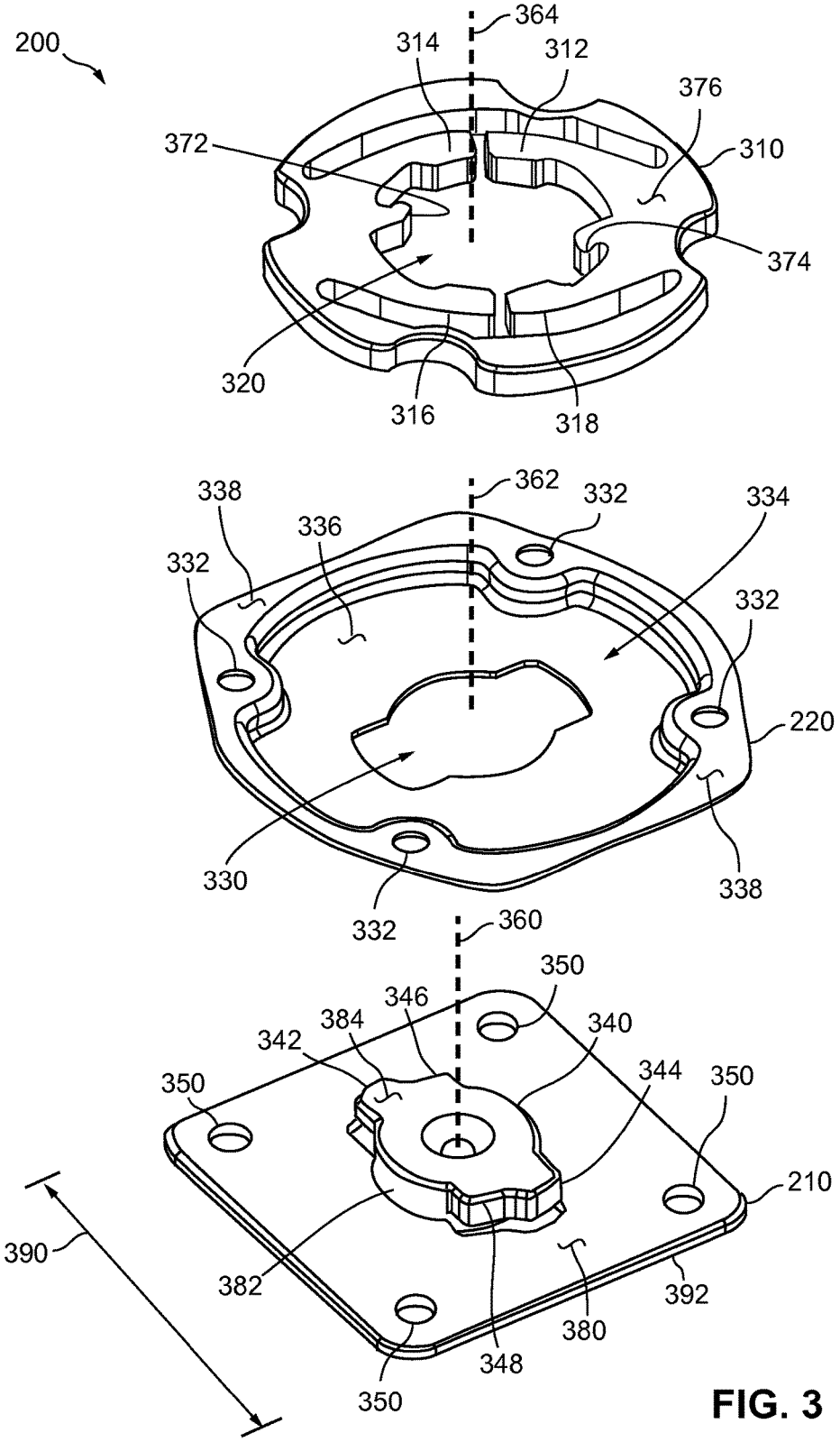
FIG. 3 is a exploded plan view that is to scale of the ring, cover, and base of the coupler of FIG. 2.

As discussed above, when base 210 is in the decoupled position and is move as close is it can to cover 220, upper surface 384 of post 340 does not extend above (e.g., beyond, past) surface 338 of cover 220. In FIG. 3, post 340 is not in the decoupled position because protrusions 342-348 are rotated about 90 degrees with respect to cover 220 so that protrusions 342-348 cannot fit through opening 330 or opening 320. When ring 310 is positioned in recess 334, opening 320 aligns with opening 330 so that protrusions 342-348 may pass into openings 330 and 320 when base 210 is oriented in the decoupled position.

When base 210 is in the decoupled position and inserted into openings 320 and 330, cover 220 (e.g., edges around opening 330) are not positioned in slots 410 between underside 1010 and surface 380. However, when base 210 is rotated, in this implementation counterclockwise from the perspective of FIGS. 5 and 7-9, the edges of cover 220 around opening 330 enter slot 410 between protrusions 342-348 and surface 380. Once cover 220 is positioned in slots 410, base 210 cannot be pulled away from cover 220 because underside 1010 of protrusions 342-348 interferes with (e.g., block, collide with, hinder, contacts) surface 336 so base 210 cannot be extracted (e.g., decoupled, pulled away) from cover 220.

Figure 5:
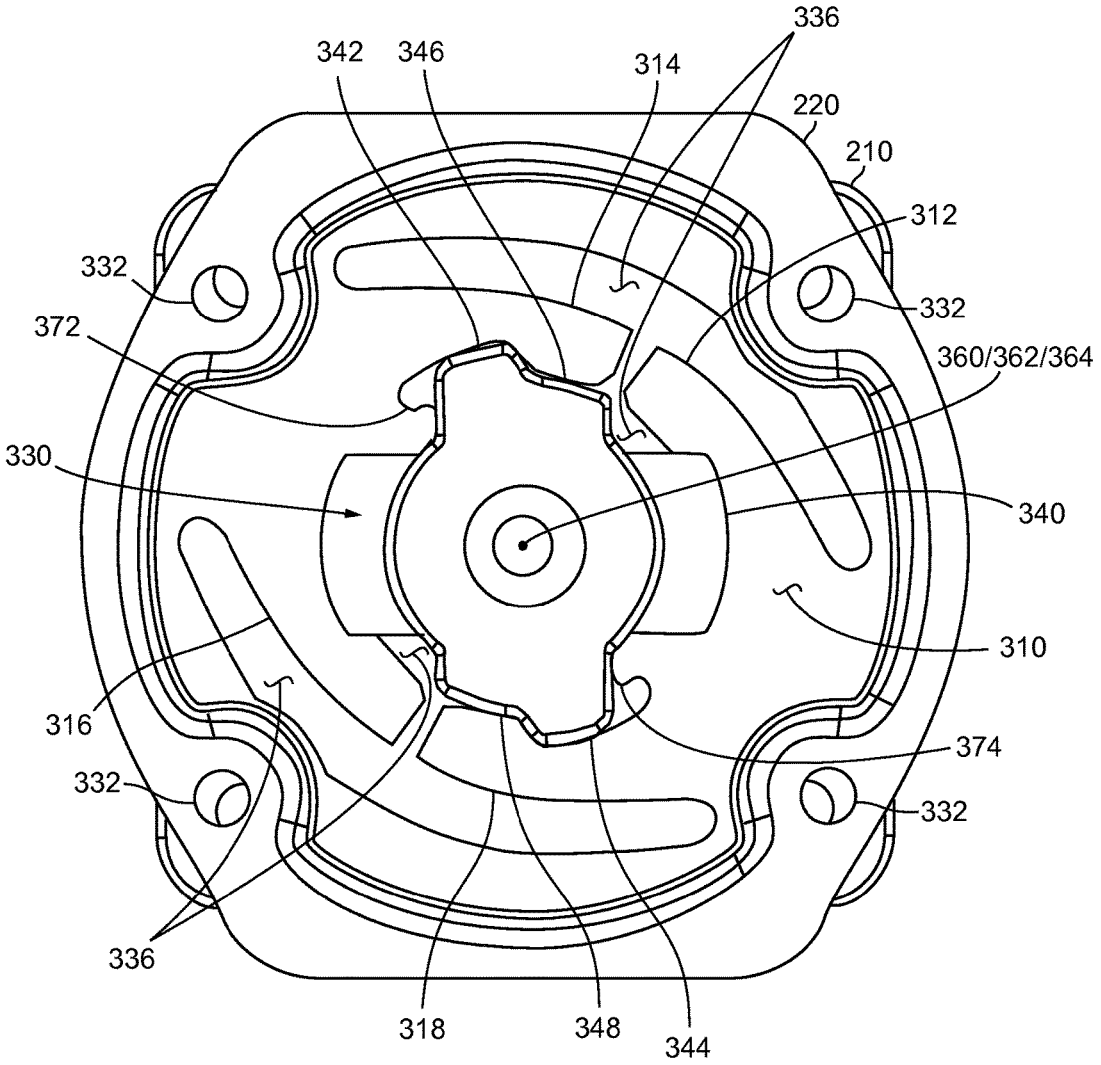
FIG. 5 is a rear view that is to scale of the coupler of FIG. 2 with the coupler in a locked position and the support removed for viewing.
Figure 6:
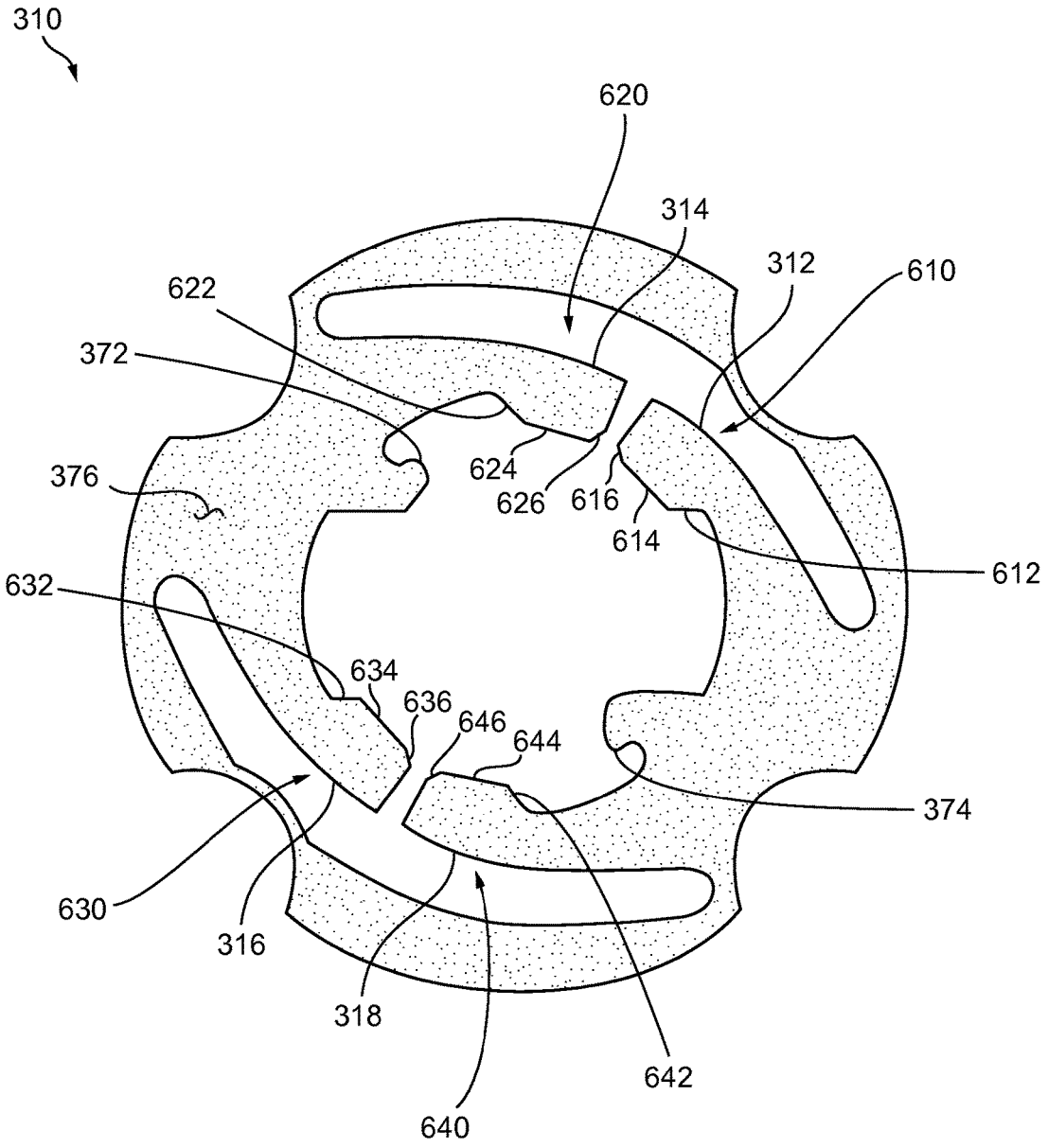
FIG. 6 is a front view of the ring of the coupler.

In FIG. 4, base 210 is inserted through openings 320 and 330 and rotated out of the decoupled position. Portions of cover 220 are positioned in slots 410 formed between underside 1010 of protrusions 342-348 and surface 380. In FIG. 5, base 210 is show in the locked position, which is discussed below. Because base 210 is not in the decoupled positioned, cover 220 is positioned in slots 410. In FIG. 5, protrusions 342-348 are shown positioned over surface 336 of cover 220. Base 210 cannot be pulled out of opening 330 because protrusions 342-348 contact surface 336 and interfere with the removal of base 210.

Rotating base 210 back to the decoupled position moves protrusions 342-348 so that cover 220 exits slots 410. Once cover 220 exits slots 410, base 210 is in the decoupled position and base 210 may be extracted from holes 320 and 330 by moving base 210 along axis 360/362/364, (axis are aligned in decoupled position) away from cover 220.

As discussed briefly above, ring 310 retains base 210 in one or more rotated positions. In an implementation, ring 310 and in particular arms 312-318 and stops 372-374, operate to hold base 210 in two positions referred to herein as an intermediate position and a locked position.

Figure 7:
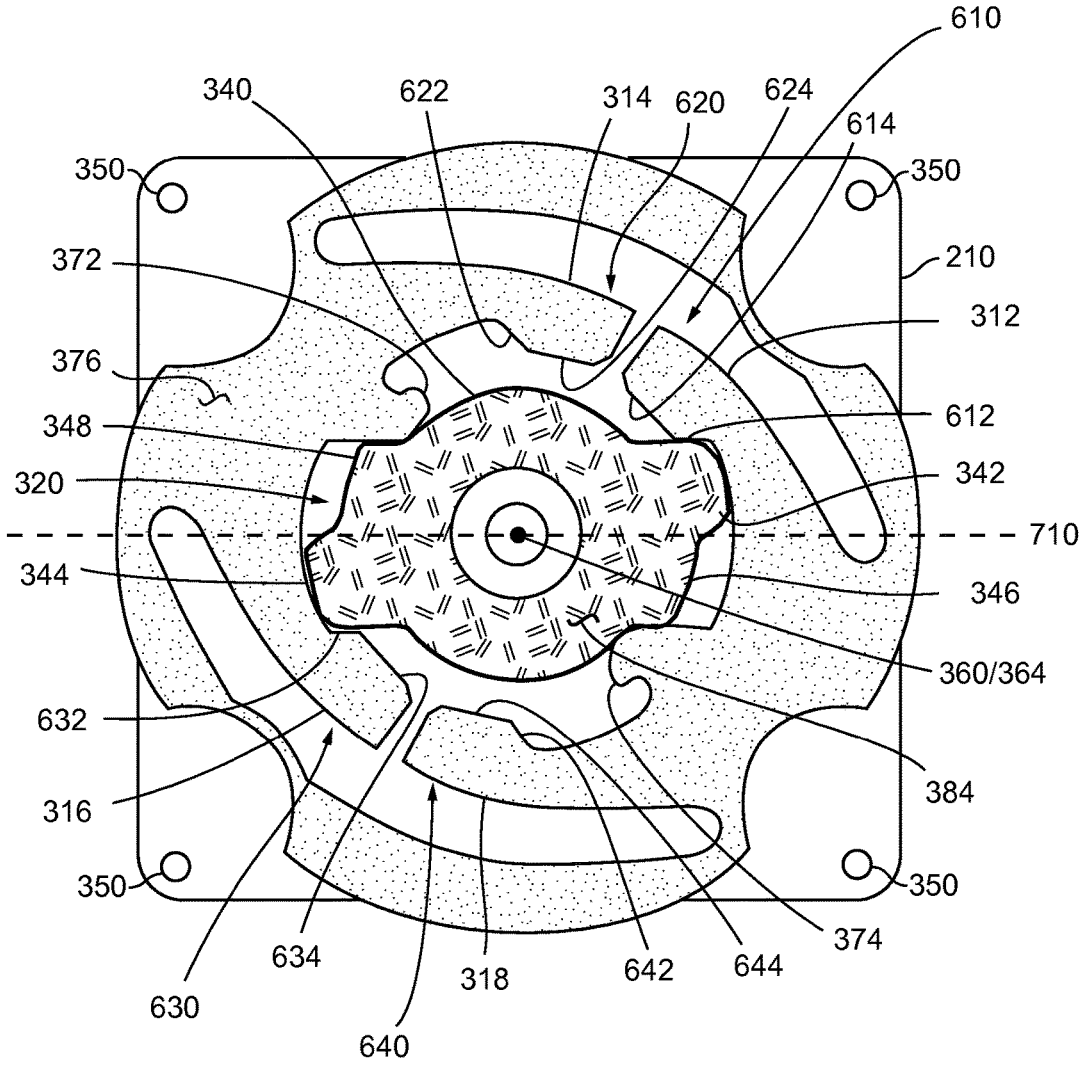
FIG. 7 is a rear view of the base and the ring, absent the cover for clarity of presentation, with the coupler in the decoupled (e.g., inserted) position.
Figure 8:
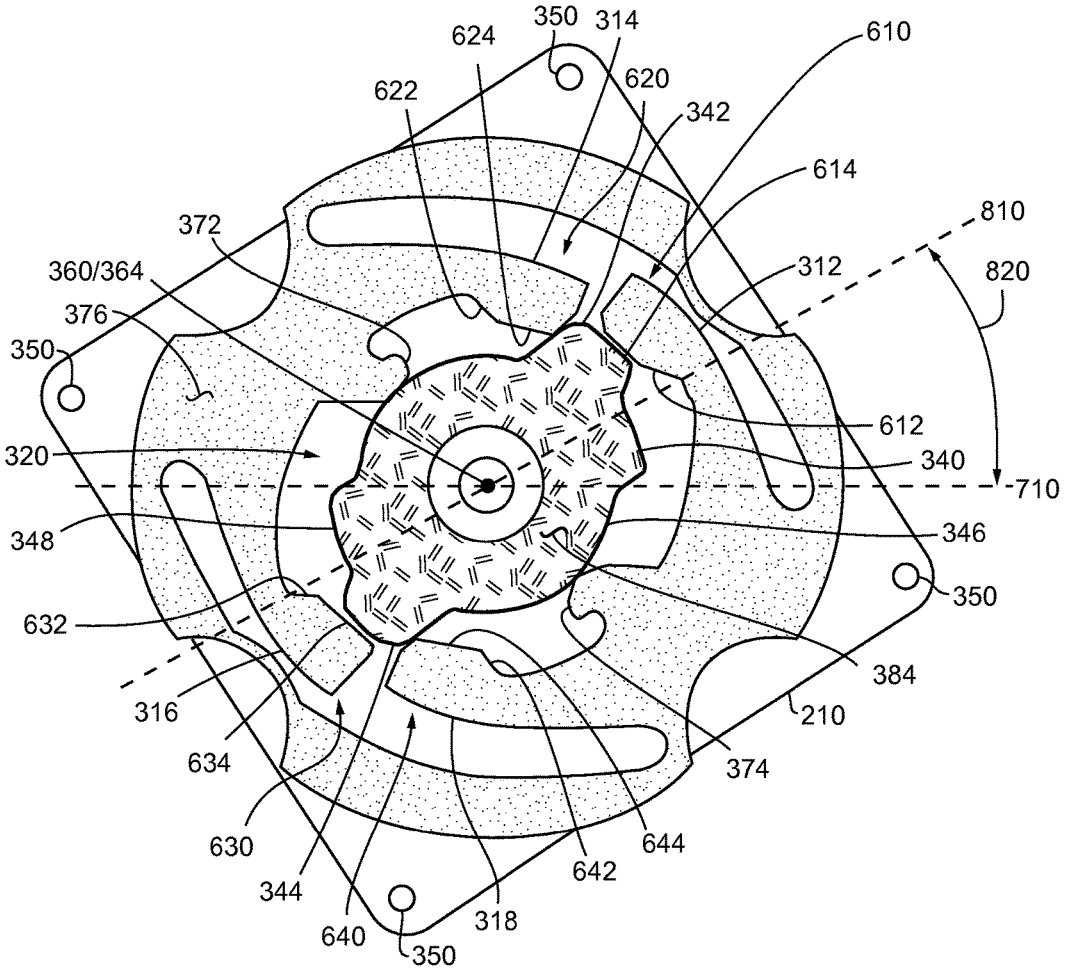
FIG. 8 is the rear view of the base and ring of FIG. 7 with the coupler in an intermediate position.
Figure 9:
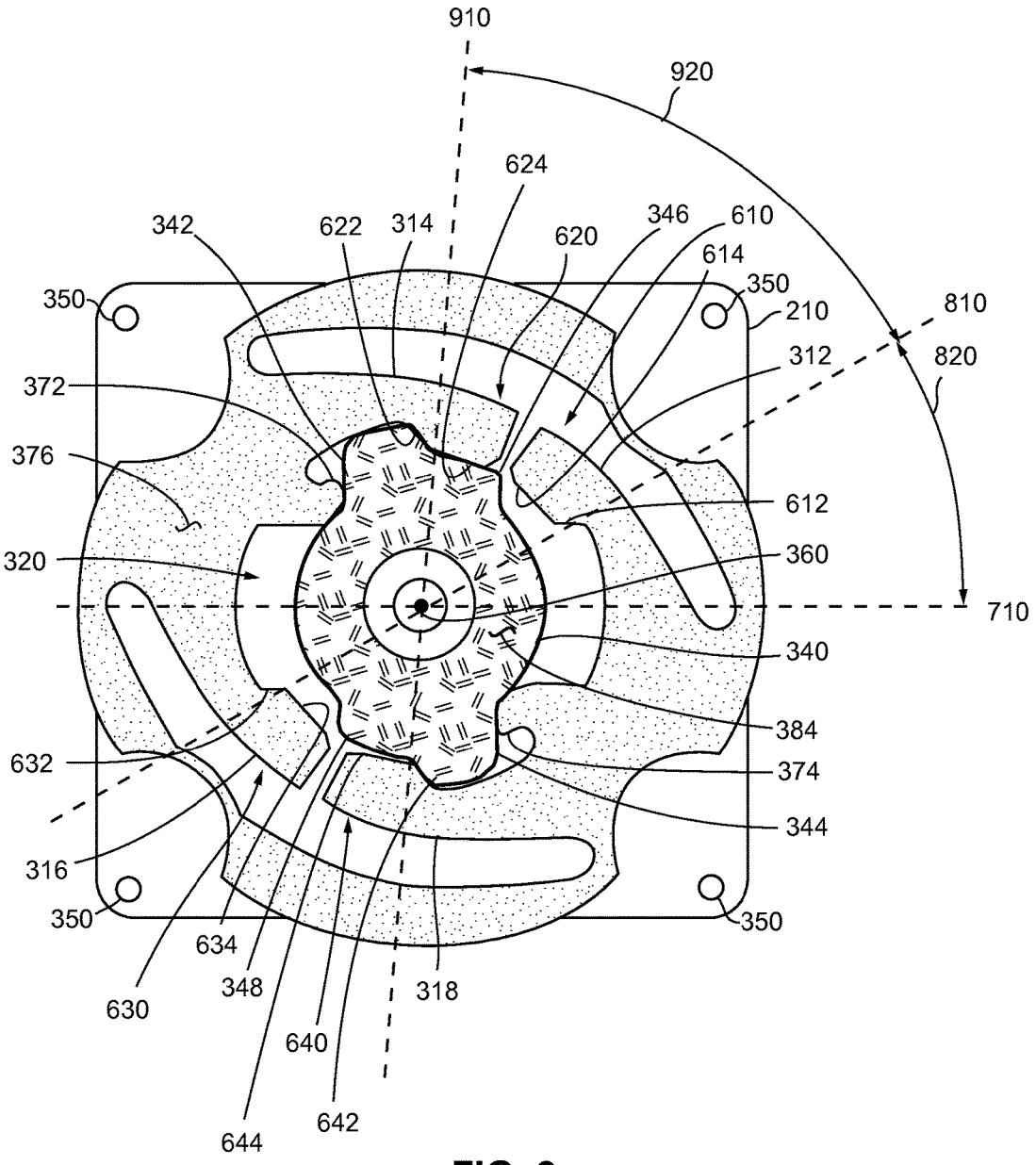
FIG. 9 is the rear view of the base and ring of FIG. 7 with the coupler in a locked position.
Figure 10:
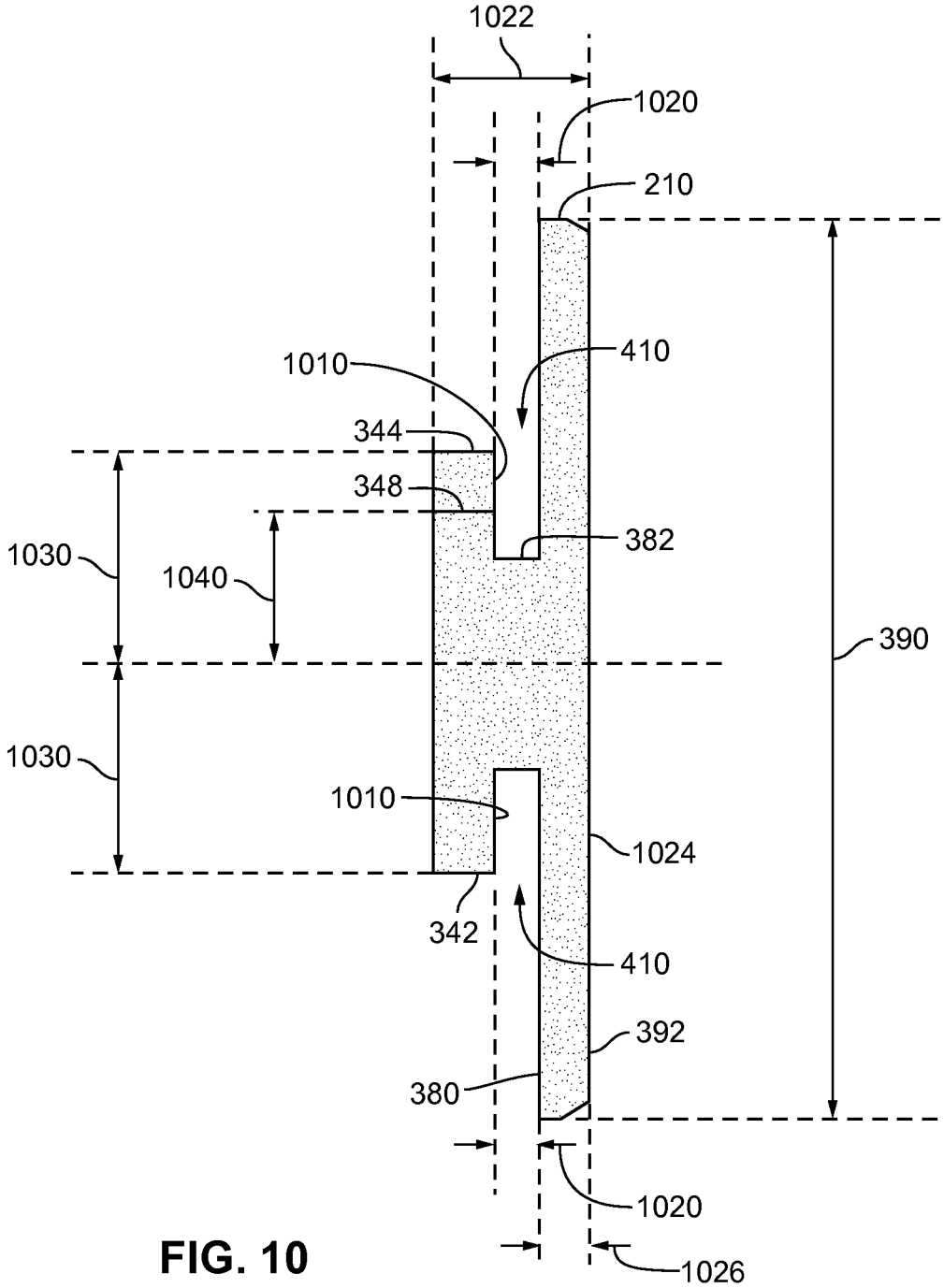
FIG. 10 is a side view of the base of the coupler.

FIG. 7-9 omit cover 220 to clarify the cooperation of ring 310 with post 340 to hold base 210 at various orientations. While base 210 is positioned in the decoupled position, as shown in FIG. 7, arms 312-318 do not apply a force on post 340. As discussed above, while base 210 is in the decoupled position, base 210 may be separated from cover 220 and ring 310 because no portion of ring 310 or cover 220 interfere with the movement of base 210 away from cover 220 and/or ring 310.

Figure 11:
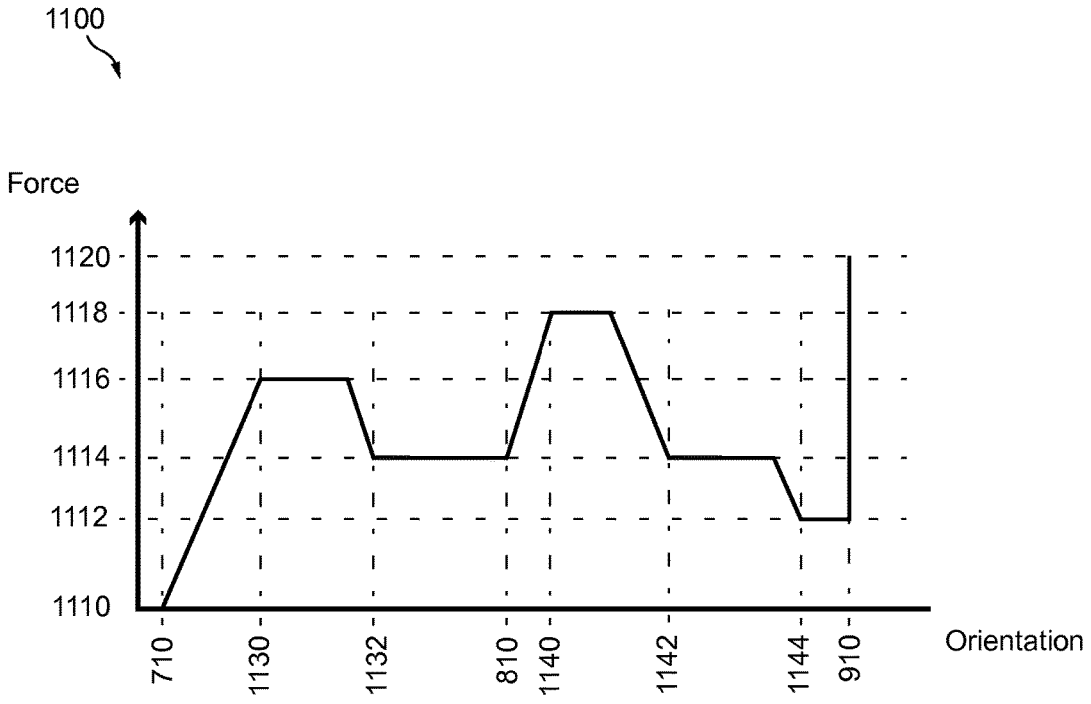
FIG. 11 is a diagram of forces required to rotate a base from a decoupled position, through an intermediate position, to a locked position.

Graft 1100 of FIG. 11 represents the relative force to rotate base 210 from the decoupled position to the locked position. The decoupled position is represented by orientation 710.

From the decoupled position, base 210 may be rotated, counterclockwise from the perspective of FIGS. 5 and 7-9. The orientation of the protrusions 342-348 with respect to ring 310 in the decoupled position is identified as orientation 710. Rotating base 210 angular distance 820 from orientation 720 to orientation 810 moves base 210 from the decoupled position to the intermediate position. Further rotating base 210 angular distance 920 from orientation 810 to orientation 910 moves base 210 from the intermediate position to the locked position. Under proper operating conditions, base 210 does not rotate further counterclockwise past the locked position.

Base 210 may be rotated, clockwise from the perspective of FIGS. 5 and 7-9, from the locked position to the intermediate position. Base 210 may be further rotated from the intermediate position to the decoupled position.

Although the above description uses the terms counterclockwise and clockwise with respect to coupling and decoupling respectively, any direction of rotation may be used for coupling and the opposite direction for decoupling so that coupling is not limited to counterclockwise rotation and decoupling is not limited to clockwise rotation.

As base 210 rotates with respect to ring 310 and cover 220, arms 312-318 cooperate with (e.g., interact with, operate on, interfere with) protrusions 342-348. As base 210 rotates from the decoupled position at orientation 710 toward intermediate position at orientation 810, protrusions 342 and 344 push against ramps 612 and 632 respectively. Ramps 612, 622, 632, and 642 are positioned at an angled, as opposed to orthogonal, to with respect to faces 614, 624, 634, and 644 respectively so that protrusions 342 and 344 may apply less on arms 312-318 to cause arms 312-318 to deflect (e.g., bend, flex) away from the center of ring 310 which corresponds to axis 360/364.

As base 210 rotates from orientation 710 to orientation 810, protrusions 342 and 344 push against ramps 612 and 632 respectively and cause arms 312 and 316 to move outward away from axis 360/364. As base 210 continues to rotate counterclockwise, protrusion 342 and 344 move past ramps 612 and 632 respectively, and along face 614 and face 634 until protrusion 342 and 344 contact end portion 620 and end portion 640 respectively. The force required to rotate base 210 so that protrusions 342 and 344 pass ramps 612 and 632 respectively, shown as amount (e.g., level, magnitude) of force 1116 in FIG. 11, is greater than the amount of force 1114 required to rotate (e.g., move) protrusions 342 and 344 along faces 614 and 634. The force required to rotate protrusions 342 and 344 past ramps 626 and 646 of end portions 620 and 640 respectively, amount of force 1118, is greater than the force, amount of force 1114, required to rotate protrusions 342 and 344 along faces 614 and 634 and greater than the force, amount of force 1116, required to rotate protrusions 342 and 344 along ramps 612 and 632, so when protrusions 342 and 344 contact end portions 620 and 640 respectively, the user turning base 210, or the object coupled to base 210, feels a definite stop (e.g., bump, pause) in the movement of base 210, or object coupled to base 210, upon reaching orientation 810.

While base 210 is positioned at orientation 810 in the intermediate position, protrusions 342 and 344 push against end portions 610 and 630 so that arms 312 and 316 remain positioned away (e.g., distal, deflected) from axis 360/364. Because arms 312 and 316 are formed of a resilient material, arms 312 and 316 apply a force on protrusions 342 and 344 respectively. The force applied by arms 312 and 316 on protrusions 342 and 344 operate to retain base 210 in the intermediate position. The interference of end portions 620 and 640 with protrusions 342 and 344 act to limit further counterclockwise rotation of base 210 without a further increase in the amount of force that operates on base 210 to cause it to rotate.

Ramps 626 and 646 of end portions 620 and 640 that are proximate to protrusions 342 and 344 while in the intermediate position are angled, as opposed to orthogonal, to faces 624 and 644 respectively to decrease the amount of force required to rotate base 210 over ramps 626 and 646 past the ends of arms 314 and 318. However, the angle of ramps 626 and 646 with respect to faces 614 and 634 respectively is greater than the angle of ramps 612 and 632 with respect to faces 614 and 634 respectively, so the amount of force, amount of force 1118, required to rotate protrusions 342 and 344 past ramps 626 and 646 is greater than the amount of force, amount of force 1116, required to rotate protrusions 342 and 344 past ramps 612 and 632.

Base 210 remains in the intermediate position as long as a force applied to base 210 in the clockwise direction is less than the force applied by arms 312 and 316 on protrusions 342 and 344 respectively and the force applied to base 210 in the counterclockwise direction is less than the force, amount of force 1118, required to move protrusions 342 and 344 past ramps 626 and 646 of end portions 620 and 640.

When a user applies the force, amount of force 1118, required to move protrusions 342 and 344 along ramps 626 and 646 past the ends of end portions 620 and 640, base 210 begins to rotate from orientation 810 toward orientation 910. Protrusions 342 and 344 push arms 314 and 318 outward away from axis 360/364 as protrusions 432 and 344 move along ramps 626 and 646 respectively. As protrusions 342 and 344 move down ramps 616 and 636 and past end portions 610 and 630, arms 312 and 316 move toward axis 360/364 until they return to their original positions. Further, as protrusions 342 and 344 move past arms 312 and 316, the force applied by arms 312 and 316 on protrusions 342 and 344 decreases.

Protrusions 342 and 344 push arms 314 and 318 outward as protrusions 342 and 344 move along ramps 626 and 646 until protrusions 342 and 344 reach faces 624 and 644. As base 210 continues to rotate, protrusions 342 and 344 move along face 624 and 644 respectively. The force, amount of force 1114, required to move protrusions 342 and 344 along face 624 and 644 respectively, is less than amount of force 1118 and amount of force 1116. While arms 314 and 318 are pushed outward by protrusions 342 and 344, arms 314 and 318 apply a force on protrusions 342 and 344. Base 210 continues to rotate counterclockwise until protrusions 342 and 344 reach ramps 622 and 642 respectively. As protrusions 342 and 344 reach ramps 622 and 642 respectively, the force required to rotate base 210 in a counterclockwise direction down ramps 622 and 642 decreases because of the orientation of ramps 622 and 642 with respect to faces 624 and 644 and because the force applied by arms 314 and 318 on protrusions 342 and 344 helps to move protrusions 342 and 344 down ramps 622 and 642. The force, amount of force 1112, required to move protrusions along ramps 622 and 642 is less than amount of force 1114, 1116, and 1118.

After protrusions 342 and 344 have cleared (e.g., moved past) ramps 622 and 642, protrusions 342 and 344 contact stops 372 and 374 respectively and base 210 is positioned at orientation 910. While at orientation 910, base 210 is in the locked position.

Amount of force 1118 required to rotate base 210 so that protrusions 342 and 344 move counterclockwise along ramps 626 and 646 past the ends of end portions 620 and 640 respectively is greater than the force, amount of force 1114, required to rotate protrusions 342 and 344 along faces 624 and 644 respectively. Amount of force 1112 required to rotate base 210 so that protrusions 342 and 344 pass along ramps 622 and 642 respectively is less than the force, amount of force 1114, required to move protrusions 342 and 344 along faces 624 and 644 respectively. When protrusions 342 and 344 contact stops 372 and 374 respectively base 210 stops rotating and base 210 is at orientation 910.

Stops 372 and 374 do not include angled surfaces. Stops 372 and 374 contact a portion of protrusions 342 and 344 respectively that is closer to axis 360/364, as opposed to a portion closer to an end portion of protrusions 342 and 344, to increase the force required to move protrusions 342 and 344 past stops 372 and 374. Under proper operation, base 210 does not rotate counterclockwise past orientation 910. Rotating base 210 counterclockwise past orientation 910 would require breaking off stops 372 and 374. Amount of force 1120 required to rotate base 210 past stops 372 and 374 represents a force that is significantly greater than amount of force 1112, 1114, 1116, and 1118.

While base 210 is positioned at orientation 910 in the locked position, stops 372 and 374 stop (e.g., limit, impair, halt) further counterclockwise rotation while at the same time end portions 620 and 640 resist clockwise rotation. While base 210 is in the locked position, arms 314 and 316 may apply some pressure on protrusions 342 and 344 and end portions 620 and 640 may apply some pressure on protrusions 346 and 348 respectively to resist clockwise movement of base 210 out of orientation 910.

The forces show in FIG. 11 are relative to each other and are not absolute representations of force. The levels of force in FIG. 11 are not to scale and show only a relative increase or decrease of the amount of force. The positive or negative slope in the line of graph 1100 has no meaning. The change in force to rotate base 210 may occur with little change in the orientation of base 210 or base 210 may rotate slightly as the level of force increases or decreases between the levels of force (e.g., 1112, 1114, 1116, 1118) shown in FIG. 11.

At orientation 1130, protrusions 342 and 344 start to move along ramps 612 and 632 respectively. At orientation 1132, protrusions 342 and 344 start to move off of ramps 612 and 632 and along faces 614 and 624 respectively. At orientation 810, base 210 is in the intermediate position. At orientation 1140, protrusions 342 and 344 start to move along ramps 626 and 646. The force required to for protrusions 342 and 344 to move down ramps 616 and 636 is not shown because movement down ramps 616 and 636 occurs after movement of protrusions 342 and 344 up ramps 626 and 646. At orientation 1142, protrusions 342 and 344 start to move off of ramps 626 and 646 respectively and along faces 624 and 644 respectively. At orientation 1144, protrusions 342 and 344 start to move down ramps 622 and 642.

Many factors affect the force required to rotate base 210 from one orientation to another orientation. Factors include the resilient force applied by each arm 312-318 on protrusions 342-348, the orientation (e.g., angles) between surfaces on ring 310, the shape of protrusions 342-348, in particular the shape of protrusions 342 and 344, and a coefficient of friction between protrusions 342-348 and the surfaces of ring 310.

Protrusions 342 and 344 are diametrically (e.g., oppositely, 180 degree difference, mirrored) positioned with respect to each other across axis 360. Protrusions 346 and 348 are also diametrically positioned with respect to each other across axis 360. When protrusions 342 or 346 are positioned so that arms 312 or 314 applies a force to protrusion 342 or 346, an opposite, and preferably equal, force is apply by arms 316 and 318 to protrusion 344 and protrusion 348. Arms 312-318 are positioned symmetrically (e.g., mirrored) in ring 310. Arms 312 and 316 are positioned opposite each other across axis 364. Arms 314 and 318 are positioned opposite each other across axis 364. Because protrusions 342 and 344 are positioned opposite each other across axis 360, when arm 312 applies a force to protrusion 342, protrusions 344 is positioned so that arm 316 applies an opposing force (e.g., force in opposite direction to arm 312) to protrusion 344 at the same time. When arm 314 applies a force to protrusion 342, protrusion 344 is positioned so that arm 318 applies an opposing force to protrusions 344 at the same time. When arm 314 applies a force to protrusion 346, protrusion 348 is positioned so that arm 318 applies an opposing force to protrusion 348. Opposing arms interact with and operate on opposing protrusions at the same time.

The simultaneous opposing (e.g., symmetrical) forces that are applied to protrusions 342-348, as discussed above, result from symmetry of arms 312-318 in ring 310. The symmetrical application of force by arms 312-318 on protrusions 342-348 improves retention of base 210 at any particular rotated orientation. The symmetry of arms 312-318 and protrusions 342-348 causes arm pair 312/316 and arm pair 314/318 to operate against protrusions 342/344 and 346/348 to apply opposing forces to post 340 to retain base 210 at rotated positions.

Because arms 312 and 316 cooperate with each other and arms 314 and 318 cooperate with each other to respectively apply force on post 340, arm pair 312/316 may operate distinctly from air pair 214/318. For example, the resilient material that forms arm pair 312/316 may be different from the resilient material that forms arm pair 314/318 so that arms of a pair apply the same amount of force on post 340 while arm pairs apply a different amount of force on post 340. For example, arm pair 314/318 may be formed of a more resilient (e.g., stiffer, springier) material than used to form arm pair 312/316 so that rotating base 210 from decoupled position 710 to intermediate position 810 takes less force than rotating base 210 from intermediate position 810 to locked position 910. The same may be done in reverse so that arm pair 314/318 is formed of a more resilient material than arm pair 312/316 so that more force is required to rotate base 210 from decoupled position 710 to intermediate position 810 than from intermediate position 810 to locked position 910.

Preferably, each arm of arm pair 312/316 and arm pair 314/318 have the same resilient characteristics so that the force applied by the arms of an arm pair on post 340 is about equal in the amount of force and opposing in direction.

The orientations where base 210 is retained (e.g., 810, 910) may be at any position along an arc. The angular distances between orientations where base 210 is retained may be equal or different. An angular distance from one orientation to another orientation may be the same or different. For example, angular distance 820 and 920 may be the same or different. Angular distance 820 may be greater than angular distance 920 or vice versa.

To decoupled base 210 from cover 220, base 210 is rotated from the locked position at orientation 910, to the intermediate position at orientation 810, and from the intermediate position to the decoupled position at orientation 710.

From the stopped position, rotating base 210 clockwise, with respect to FIGS. 7-9, forces protrusions 342 and 344 against ramps 622 and 642 respectively. As protrusions 342 and 344 travel along ramps 622 and 642, protrusions push arms 314 and 318 outward away from 360/364. As arms 314 and 318 are pushed outwardly, arms 314 and 318 apply a force on protrusions 342 and 344 respectively. As base 210 continues to rotate clockwise, protrusions 342 and 344 move across faces 624 and 644 until a portion of (e.g., edge) of protrusions 342 and 344 contact the ends of end portions 610 and 630 of arms 312 and 316. Contact with end portions 610 and 630 creates an greater resistance to rotation in the clockwise direction that requires additional force to overcome to continue clockwise rotation.

This position, when protrusions 342 and 344 contact the ends of end portions 610 and 630 of arms 312 and 316, may be referred to as the intermediate return position. The intermediate return position is not the same as the intermediate position. The orientation of the intermediate return position lies between orientation 810 and 910.

While base 210 is positioned in the intermediate return position, protrusions 342 and 344 push arms 314 and 318 respectively outward. Because arms 314 and 318 are arm formed of a resilient (e.g., springy, elastic) material, while arms 314 and 318 are pushed outward, they exert a force on protrusions 342 and 344 that acts to maintain base 210 in the intermediate return position.

From the intermediate return position, applying additional force pushes protrusions 342 and 344 with greater force against end portions 610 and 630. End portions 610 and 630 may include an angle so that the end of end portions 610 and 630 are not orthogonal to face 614 and 634 respectively. As protrusions 342 and 344 push on (e.g., cooperate with, interact with, operate on) end portions 610 and 630, arms 312 and 316 begin to move outwardly away from axis 360/364. As protrusions 342 and 344 move along face 614 and 634, protrusions 342 and 344 move past arms 314 and 318 so that arms 314 and 318 move inwardly toward axis 360/364. When protrusions 342 and 344 clear end portions 620 and 640 of arms 314 and 318, arms 314 and 318 move back to their original position.

As base 210 continues to rotate clockwise, protrusions 342 and 344 move across faces 614 and 634 respectively, and across ramps 612 and 632 until protrusions 346 and 348 contact stops 374 and 372 respectively. Clockwise rotation stops when protrusions 346 and 348 contact stops 374 and 372 and base 210 is in the decoupled position at orientation 710.

From the stopped position, the force required to move protrusions 342 and 344 clockwise along ramps 622 and 642 respectively is greater than the force required to move protrusions 342 and 344 clockwise along faces 624 and 644. Once protrusions 342 and 344 have contacted the end of end portions 610 and 630, the force to continue clockwise rotation in greater than the force required to move protrusions 342 and 344 along faces 624 and 644. The force required to move protrusions 342 and 344 along faces 614 and 634 respectively is less than the force required to move protrusions 342 and 344 past the end of end portions 610 and 630. The force required to move protrusions 342 and 344 along ramps 612 and 632 is less than the force required to move protrusions 342 and 344 along faces 624 and 644.

Once protrusions 346 and 348 contact stops 374 and 372 respectively, the force required for continued clockwise movement is very high. In normal operation, base 210 cannot rotate in a clockwise direction past orientation 710. The force required to move past stops 372 and 374 would break stops 372 and 374.

Once base 210 is back in the decoupled position at orientation 710, base 210 may be separated from cover 220 and ring 310.

As discussed above, while base 210 is coupled to cover 220, upper surface 384 of base 210 does not extend above (e.g., beyond) surface 338 of cover 220 or surface 376 of ring 310. So, the entire thickness (e.g., width) of coupler 200 may be the same or slightly more than the width of base 210. For example, in an implementation, base 210 has thickness 1022. If upper surface 384 does not extend past surface 388 or surface 376, coupler 200 may have a thickness that is about the same as thickness 1022. If upper surface 384 does not quite reach the same level as surface 338 (e.g., it is below), then the thickness of coupler 200 may be more than thickness 1022 by the amount of difference between upper surface 384 and surface 338.

In light of the construction and thickness 1022 of base 210, coupler 200 may be relatively thin (e.g., low profile) when compared to the objects to which base 210 may be attached. For example, for DVR that has a thickness of 0.8 inches (i.e., 20.32 mm), connector 200 with a thickness of only 5 mm is only one quarter of the thickness of the DVR.

In an implementation, coupler 200 may couple a DVR to a person. A DVR coupled to a person may be used to record an event (e.g., occurrence, incident). In accordance with the above discussion, base 210 couples to DVR 120, cover 220 couples to the uniform 130 of the officer 110. Ring 310 is positioned in recess 334.

Officer 110 couples DVR 120 to uniform 130 by rotating camera so that base 210 is oriented at orientation 710. While DVR 120 is rotated so that base 210 is oriented at orientation 710, the lens of DVR is not oriented upright, so any video taken by DVR 120 while base 120 is in position 720 would be rotated about 90 degrees to the right so that the heads of people standing upright would be oriented to the right side of the picture.

While DVR 120 is rotated so that base 210 is at orientation 710, officer 110 aligns axis 360 of base 210 with axis 362 of cover 220 and 364 of ring 310 and inserts post 340 into opening 330 and aligned opening 320 until surface 380 touches cover 220. Base 210 is now in the decoupled position.

Officer 110 rotates DVR 120 counterclockwise, from the perspective of officer 110, until officer feels increased resistance and possibly hears an audible clicking sound of protrusions 342 and 344 hitting the end of end portions 620 and 640. At this orientation, base 210 is in the intermediate position. Even though the force applied by arms 312 and 316 on protrusions 342 and 344 may hold base 210 and therefore DVR 120 in the intermediate position, DVR 120 is still oriented at an angle with respect to the officer so the video recorded by DVR 120 in the intermediate position would not show upright objects as being upright.

Officer 110 applies more force to rotate DVR 120 further counterclockwise past the intermediate position until officer 110 feels increase resistance and possible an audible click as protrusions 342 and 344 hit against stops 372 and 374 respectively. At this orientation, base 210 is in the locked position and oriented at orientation 910. In the locked position, DVR 120 is properly oriented for recording video at an angle where the objects in the recorded video will be oriented at the same orientation as viewed by officer 110. For example, the head of people who are standing or are upright will be oriented toward the top of the recorded video.

To accomplish positioning DVR 120 at an orientation for proper operation while base 210 is in the locked position, DVR 120 must be oriented with respect to base 210, base 210 must be oriented with respect to cover 220 and cover 220 must be oriented with respect to uniform 130 so that rotating base 210 to the lock position results in positioning DVR 120 at the desired orientation for proper operation.

DVR 120 may be decoupled from uniform 130 by rotating DVR 120 clockwise from the perspective of officer 120 until base 210 is in the decoupled position then officer 120 may pull base 210 away from cover 220 to accomplish decoupling and complete separation of base 210 from cover 220 and ring 210 thereby decoupling DVR 120 from the uniform of officer 110.

In an implementation, the strength of coupling between base 210 and cover 220 (e.g., coupling of base 210 to cover 220) may be increase by using a magnetic force to attract base 210 to cover 220 and vice versa. A magnetic attraction between base 210 and cover 220 may be used in addition to the force applied by ring 310 to retain base 210 at an orientation. Ring 210 may be formed of a non-magnetic material so that a magnetic force do not interfere with the operation of ring 310 to hold base 210 at an orientation as discussed above. A magnetic attraction between base 210 and cover 220 may be used to couple base 210 to cover 220 in addition to the interference between cover 220 and surface 1010 while portions of cover 220 are positioned in slot 410.

Base 210 may be formed of a material or include material that provides a magnetic force and cover 220 may be formed, in whole or part, of a material that is attracted by the magnetic force provided by base 210 or visa versa. The magnetic force cannot be so strong that once base 210 and cover 220 contact each other that base 210 cannot be rotated, due to the magnitude of the magnetic force, to position the object coupled to base 210. The magnetic force cannot be so strong that is it extremely difficult to separate base 210 from cover 220 while base 210 is in the decoupled position.

The magnetic coupling is not likely to be used alone (e.g., user forgets to rotate base 210) to couple base 210 to cover 220 because rotation of the object coupled to base 210 orients the object, in this case a DVR, for proper operation such as capturing video at the proper orientation as discussed above.

In an implementation, all or part of plate 392 is formed of a magnetic material (e.g., permanent magnet) while all or part of cover 220 is formed of a material (e.g., ferromagnetic) that is attracted to a magnetic field. In another implementation, all or part of cover 220 is formed of a magnetic material while all or part of plate 392 is formed of a ferromagnetic material.

The foregoing description discusses preferred embodiments of the present invention, which may be changed or modified without departing from the scope of the present invention as defined in the claims. Examples listed in parentheses may be used in the alternative or in any practical combination. As used in the specification and claims, the words 'comprising', 'including', and 'having' introduce an open ended statement of component structures and/or functions. In the specification and claims, the words 'a' and 'an' are used as indefinite articles meaning 'one or more'. When a descriptive phrase includes a series of nouns and/or adjectives, each successive word is intended to modify the entire combination of words preceding it. For example, a black dog house is intended to mean a house for a black dog. While for the sake of clarity of description, several specific embodiments of the invention have been described, the scope of the invention is intended to be measured by the claims as set forth below. In the claims, the term "provided" is used to definitively identify an object that not a claimed element of the invention but an object that performs the function of a workpiece that cooperates with the claimed invention. For example, in the claim "an apparatus for aiming a provided barrel, the apparatus comprising: a housing, the barrel positioned in the housing", the barrel is not a claimed element of the apparatus, but an object that cooperates with the "housing" of the "apparatus" by being positioned in the "housing".

What is claimed is:

1. A system for coupling an accessory to a support and for positioning the accessory with respect to the support, the system comprising:

a cover for coupling to the support, the cover comprising a wall and a cavity, the wall having an opening therethrough;

a ring comprising an opening therethrough, a first arm, a second arm, a third arm, a fourth arm, a first stop and a second stop, each arm formed of a resilient material, the ring positioned in the cavity; and a base for coupling to the accessory, the base comprising a post, the post comprising a first protrusion, a second protrusion, each protrusion comprising a surface spaced apart from a surface of the base to form a slot between each protrusion and the surface of the base, the post inserted through the opening in the cover and the opening in the ring to position the base in a decoupled position, the base rotatable in a first direction to an intermediate position and further rotatable in the first direction to a locked position; wherein:

the first arm cooperates with the first protrusion and the third arm cooperates with the second protrusion to resist rotation of the base between the decoupled position and the intermediate position;

the first arm and an end portion of the second arm cooperate with the first protrusion, and the third arm and an end portion of the fourth arm cooperate with the second protrusion to retain the base in the intermediate position;

the second arm cooperates with the first protrusion and the fourth arm cooperates with the second protrusion to resist rotation of the base between the intermediate position and the locked position;

the second arm and the first stop cooperate with the first protrusion, and the fourth arm and the second stop cooperate with the second protrusion to retain the base in the locked position; and while the base is rotated out of the decoupled position, a portion of the wall of the cover is positioned in the slot between the protrusions and the surface of the base such that the protrusions cooperate with the cover to couple the base to the cover.

2. The system of claim 1 wherein:

the post further comprises a third protrusion and a fourth protrusion; and while the base is positioned in the locked position, the end portions of the second arm and the fourth arm apply a force on the third protrusion and fourth protrusion respectively to retain the base in the locked position.

3. The system of claim 2 wherein the first protrusion and the second protrusion extend a first distance away from the axis, the third and fourth protrusions extend a second distance away from the axis, the first distance is greater than the second distance.

4. The system of claim 1 wherein the end portion of each arm has a bulbous shape.

5. The system of claim 1 wherein while the base is positioned in the intermediate position, the first arm applies a first force on the first protrusion, the second arm interferes with movement of the first protrusion, the third arm applies a second force to the second protrusion, and the fourth arm interferes with movement of the second protrusion to retain the base in the intermediate position.

6. The system of claim 1 wherein a magnetic force between the base and the cover further operates to couple the base to the cover.

7. A system for positioning an accessory with respect to a support, the system comprising:

a cover for coupling to the support, the cover comprising a cavity and a wall, the wall having an opening therethrough;

a ring comprising an opening therethrough, a first arm, a second arm, a third arm, a fourth arm, a first stop, and a second stop, the ring positioned in the cavity, each arm formed of a resilient material, each arm comprising a bulbous end portion; and a base for coupling to the accessory, the base comprising a post, the post comprising a first protrusion, a second protrusion, and an axis, the post inserted through the opening in the cover and the opening in the ring to position the base in a decoupled position, the base rotatable in a first direction to an intermediate position and further rotatable in the first direction to a locked position; wherein:

responsive to a first rotational force applied to the base in the first direction, the first protrusion and the second protrusion push the bulbous end portions of first arm and the third arm respectively away from the axis so that the first protrusion and the second protrusion move along the first arm and the third arm until rotational movement is resisted by contact of the first protrusion and the second protrusion with the bulbous end portion of the second arm and fourth arm respectively thereby reaching the intermediate position;

while the first protrusion and the second protrusion hold the bulbous end portions of the first arm and the third arm respectively away from the axis, the first arm and the third arm apply a force on the first protrusion and the second protrusion respectively so that the base resists rotating to the decoupled position;

responsive to a second rotational force applied to the base, the first protrusion and the second protrusion push the bulbous end portions of the second arm and the fourth arm respectively away from the axis, move past the first arm and the third arm so that the first arm and the third arm are no longer pushed away from the axis, move past the bulbous end portions of the second and fourth arms, and contact the first stop and the second stop respectively thereby reaching the locked position; and the first stop and the second stop halt further rotation of the base in the first direction, and the bulbous end portions of the second arm and the fourth arm resist rotation of the base out of the locked position to the intermediate position.

8. The system of claim 7 wherein:

each protrusion comprises a surface spaced apart from a surface of the base to form a slot between each protrusion and the surface of the base;

while the base is positioned in the decoupled position, the wall of the cover is not positioned in the slot, so the base may be separated from the cover; and while the base is rotated out of the decoupled position, a portion of the wall of the cover is positioned in the slot between the protrusions and the surface of the base such that the protrusions cooperate with the cover to couple the base to the cover.

9. The system of claim 7 wherein:

the post further comprises a third protrusion and a fourth protrusion; and while the base is positioned in the locked position, the bulbous end portions of the second arm and the fourth arm apply a force on the third protrusion and fourth protrusion to further resist rotation of the base out of the locked position.

10. The system of claim 9 wherein the first protrusion and the second protrusion extend a first distance away from the axis, the third and fourth protrusions extend a second distance away from the axis, the first distance is greater than the second distance.

11. The system of claim 7 wherein a magnetic force between the base and the cover further operates to couple the base to the cover.

12. A system for positioning an accessory with respect to a support, the system comprising:

a cover for coupling to the support, the cover comprising a cavity and a wall, the wall having an opening therethrough;

a ring comprising an opening therethrough, a first arm, a second arm, a third arm, a fourth arm, the ring positioned in the cavity, each arm formed of a resilient material; and a base for coupling to the accessory, the base comprising a post, the post comprising a first protrusion, a second protrusion, a third protrusion, and a fourth protrusion, and an axis, the post inserted through the opening in the cover and the opening in the ring to position the base in a decoupled position, the base rotatable in a first direction to an intermediate position and further rotatable in the first direction to a locked position; wherein:

while rotating the base from the decoupled position to the intermediate position and while remaining in the intermediate position, an end portion of the first arm and an end portion of the third arm are pushed away from the axis by the first protrusion and the second protrusion respectively;

responsive to being pushed away from the axis, the first arm and third arm apply a first force and a second force respectively to the first protrusion and the second protrusion respectively that resists rotation of the base in a second direction opposite the first direction from the intermediate position to the decoupled position;

while rotating from the intermediate position to the locked position, an end portion of the second arm and an end portion of the fourth arm at first pushed away from the axis by the first protrusion and the second protrusion respectively, then move toward the axis as the first protrusion and the second protrusion move past the end portions of the second arm and fourth arm; and while in the locked position, the end portion of the second arm and the end portion of the fourth arm interfere with the first protrusion and the second protrusion respectively, and apply a force on the third protrusion and the fourth protrusion respectively that resists rotation of the base in the second direction out of the locked position.

13. The system of claim 12 wherein:

each protrusion comprises a surface spaced apart from a surface of the base to form a slot between each protrusion and the surface of the base;

while the base is positioned in the decoupled position, the wall of the cover is not positioned in the slot, so the base may be separated from the cover; and while the base is rotated out of the decoupled position, a portion of the wall of the cover is positioned in the slot between the protrusions and the surface of the base such that the protrusions cooperate with the cover to couple the base to the cover.

14. The system of claim 12 wherein the end portion of each arm has a bulbous shape.

15. The system of claim 12 wherein the first protrusion and the second protrusion extend a first distance away from the axis, the third and fourth protrusions extend a second distance away from the axis, the first distance is greater than the second distance.

16. The system of claim 12 wherein a magnetic force between the base and the cover further operates to couple the base to the cover.

* * * * *